US007317391B2

(12) United States Patent
Schmidl

(10) Patent No.: US 7,317,391 B2
(45) Date of Patent: Jan. 8, 2008

(54) SAFETY ALERT DEVICE

(75) Inventor: Joachim Schmidl, Munich (DE)

(73) Assignee: Robert Bosch GmbH, Stuttgart (DE)

( * ) Notice: Subject to any disclaimer, the term of this patent is extended or adjusted under 35 U.S.C. 154(b) by 30 days.

(21) Appl. No.: 10/505,378

(22) PCT Filed: Jun. 2, 2003

(86) PCT No.: PCT/DE03/01807

§ 371 (c)(1),
(2), (4) Date: Aug. 20, 2004

(87) PCT Pub. No.: WO2004/017274

PCT Pub. Date: Feb. 26, 2004

(65) Prior Publication Data

US 2005/0156729 A1 Jul. 21, 2005

(30) Foreign Application Priority Data

Jul. 30, 2002 (DE) ..... 102 34 612

(51) Int. Cl.
*G08B 13/26* (2006.01)

(52) U.S. Cl. ..... 340/562; 340/506; 340/538.1; 340/825.52; 340/524

(58) Field of Classification Search ..... 340/562, 340/501, 517, 518, 825.52, 825.21, 506, 340/514, 530, 609, 628, 524–525, 538.1; 315/35, 36; 361/1, 117, 126–128
See application file for complete search history.

(56) References Cited

U.S. PATENT DOCUMENTS

| | | | | |
|---|---|---|---|---|
| 4,423,410 | A * | 12/1983 | Galvin et al. | 340/525 |
| 4,568,919 | A * | 2/1986 | Muggli et al. | 340/518 |
| 5,097,259 | A * | 3/1992 | Testa et al. | 340/825.36 |
| 5,334,970 | A * | 8/1994 | Bailey | 340/506 |
| 5,468,919 | A * | 11/1995 | Shiozaki et al. | 174/261 |
| 5,499,023 | A * | 3/1996 | Goldschmidt | 340/870.37 |
| 6,236,217 | B1 * | 5/2001 | Lewis et al. | 324/523 |
| 6,459,370 | B1 * | 10/2002 | Barrieau et al. | 340/514 |
| 6,583,628 | B2 * | 6/2003 | Ropke | 324/523 |
| 2002/0057198 | A1 | 5/2002 | Ropke | |

FOREIGN PATENT DOCUMENTS

DE 100 51 329 A1 4/2002

* cited by examiner

*Primary Examiner*—Benjamin C. Lee
*Assistant Examiner*—Daniel Previl
(74) *Attorney, Agent, or Firm*—Michael J. Striker

(57) ABSTRACT

A danger warning system includes a central station and modules connected via at least one series connection. A mechanism in the central stations determines the distance between the central station and the modules. The modules are triggered by the central station, such that an energy store is charged in the central station, and the mechanism for determining the distance evaluates the charging time of the energy store.

4 Claims, 1 Drawing Sheet

SAFETY ALERT DEVICE

CROSS-REFERENCE

The invention described and claimed hereinbelow is also described in PCT/DE 03/01807, filed Jun. 2, 2003, based upon German Patent Application 102 34 612.7, filed Jul. 30, 2002. This German Patent Application, whose subject matter is incorporated here by reference, provides the basis for a claim of priority of invention under 35 U.S.C. 119(a)-(d).

BACKGROUND OF THE INVENTION

The present invention is directed to a danger warning system with modules connected via at least one series connection.

A danger warning system is known from DE 100 51 329 A1, according to which various detectors and, possibly, other line elements are connected with a central station via a double-wire line. If a short circuit occurs, the location where it occurs is determined by calculating the voltage drop over the line sections leading up to this short circuit via the current that flows through a measuring resistor. This makes it possible to determine the length to the short circuit.

SUMMARY OF THE INVENTION

In contrast, the danger warning system according to the invention with modules connected via at least one series connection had the advantage that the installation site of each individual module is now possible via the charging time of an energy store on the central station. As a result, it is possible that the installation site of the particular module can be determined independently of its logical address and without a manual adjustment, and it can be digitally processed further. This is necessary with a larger number of modules in particular.

It is particularly advantageous that the energy store is configured as a capacitor, whereby the voltage is capable of being monitored via the capacitor using a comparator circuit, and a counter for measuring the charging time is provided. The configuration of a chain of resistors to which the individual modules are connected further permits the installation site of the particular module to be counted off.

Means for reference measurement which check the capacitor at certain points in time are advantageously provided; this allows the operatability of the capacitor to be detected. It is furthermore advantageous that switches are provided for discharging and for charging. This makes it possible for the capacitor to be switched back and forth between these two modes.

BRIEF DESCRIPTION OF THE DRAWINGS

An examplary embodiment of the invention is shown in the drawing and explained in greater detail in the description below.

DETAILED DESCRIPTION OF THE PREFERRED EMBODIMENTS

Danger warning systems are typically composed of a central processing unit, i.e., a central station, and a number of peripheral elements, i.e., modules, such as sensors for fire detection and for detecting entry into protected areas. These peripheral elements are combined into groups and connected with the central processing device via interface devices.

In the present case, this interface device is referred to as a module. If a number of modules is now operated in a system, it is necessary to determine the installation site of the individual module in the overall system.

This is achieved according to the invention by the fact that the modules are triggered, via a control command, to close switches, in order to apply a specified voltage to a chain of resistors—which is how the series connection between the central station and the modules is configured—and therefore to apply the specified voltage to this series connection. An energy store in the central station can therefore be charged. The time required until the voltage value has reached the value set at a comparator circuit is an indication of the installation site of the module. A further control command re-opens the switch on the module. To eliminate tolerances in the energy store, in particular in the capacitor, a reference measurement is carried out with a switch before each measurement series.

Figure 1:
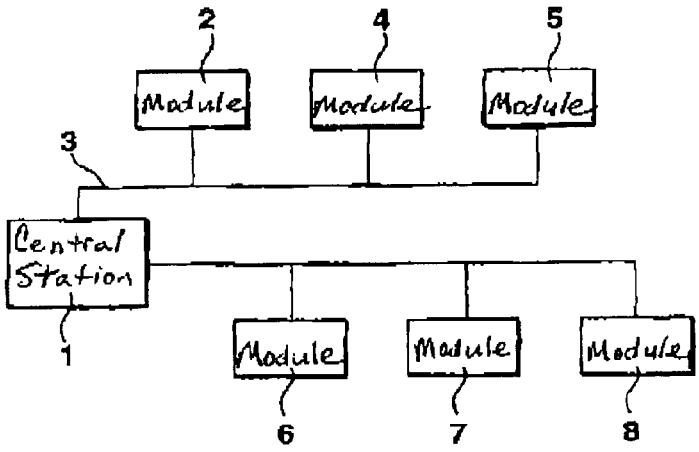
FIG. 1 shows a block diagram of a danger warning system.

FIG. 1 is a schematic depiction of the principle design of a danger warning system. A central station 1 is connected with modules 2, 4 and 5 via a serial line 3. Central station 1 processes data that come from individual modules 2, 4 and 5, which are alarms and other signaling devices or actuators. When they are actuators, in particular, central station 1 performs control functions of the individual modules by forwarding control commands to the individual modules via line 3. Serial line 3 can be configured as a double-wire line; it is a bus in this case, in particular. Suitable methods are provided that allow the bus traffic to take place in orderly fashion. A further serial line 9 can be connected to central station 1, with which said line further modules 6, 7 and 8 are connected. It is possible that more than these two serial lines are connected to central station 1, in particular when loops are connected that begin and end in central station 1.

Figure 2:
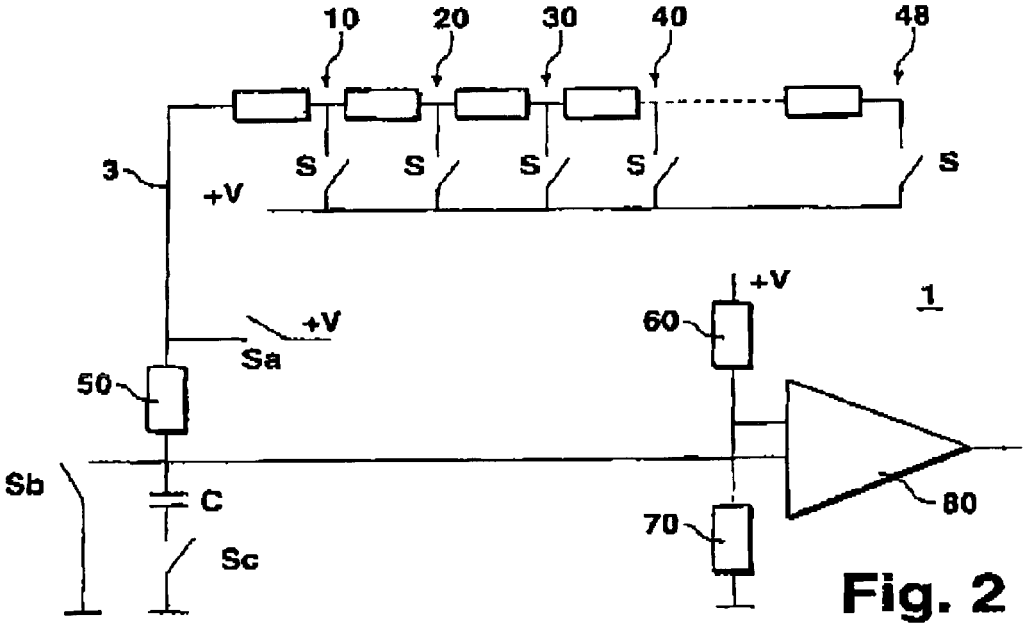
FIG. 2 shows a detailed illustration of the danger warning system according to the invention.

FIG. 2 shows in detail how central station 1 detects the installation site of the individual modules. One part of central station 1 is shown in the lower part of FIG. 2. A resistor 50 is connected to line 3, which is connected at its other side with a switch SB, a capacitor C, and a comparator 80. On the first side, the resistor 50 is also connected via line 3 with a switch SA and a first resistor in a chain of resistors. Capacitor C is connected on its other side with a switch SC which, in turn, is connected to ground. Switch SB is also connected to ground, on its other side. Switch SA is connected with operating voltage V on its other side. On its other side, the first resistor in the chain of resistors is connected with a switch S and the second resistor in the chain of resistors. This point is the slot for module 2, for example. On its other side, the second resistor in the chain of resistors is also connected with a switch S and the third resistor in the chain of resistors. Slot 20 is provided here for a further module. On its other side, the third resistor in the chain of resistors is also connected with a switch S and the fourth resistor in the chain of resistors. Slot 30 is provided here for a further module. On its other side, the fourth resistor in the chain of resistors is connected with a switch S and a fourth resistor in the chain of resistors. Slot 40 is provided here for a further module. The chain of resistors also terminates with a resistor, which is connected with a switch S. The last slot is labeled here with the numeral 48. Switches S are connected on their other sides with operating voltage V. Comparator 80 is connected via its other input with a resistor 60 and a resistor 70. Resistor 70 is connected on its other side to ground, while resistor 60 is connected on its other side with operating voltage V. A signal is output at the outlet of comparator 80 when capacitor C has reached a specified charging voltage as a result of the charging. This time is counted by a counter in a part (not shown) of central station 1.

One of the modules is triggered first of all via a control command of central station 1 to close one of the electronic switches S and therefore apply voltage V to the chain of resistors. Switch SC is then closed. As a result, capacitor C can now charge. The time required until the voltage value has reached the value that is set at comparator 80 is an indicator of the installation site of the particular module. With a further control command, switch S on the module is re-opened. Switch SB is then closed, in order to discharge capacitor C. Switches SB and SC are then re-opened, to be ready for a further measurement. To eliminate tolerances at capacitor C, a reference measurement is carried out before each measurement series with switch SA. The control is carried out by a processor (not shown), which is connected via lines with switches SA, SB and SC in central station 1. As an alternative, a switching mechanism can be used to activate the switches.

What is claimed is:

1. A danger warning system with a central station and modules connected via at least one series connection, whereby means are provided in the central station for determining a distance between the central station and the modules to determine an installation site of each of the modules in the system, wherein the modules are triggered by the central station such that an energy store is charged in the central station, whereby the means for determining the distance evaluate the charging time of the energy store which is indicative of the installation site of each of the modules.

2. The danger warning system as recited in claim 1, wherein the energy store is a capacitor, wherein the voltage is monitored via the capacitor using a comparator circuit, and a counter for measuring the charging time is provided, wherein the series connection is configured as a chain of resistors.

3. The danger warning system as recited in claim 1, wherein switches are provided that can switch the energy store between an operating phase and a discharge phase.

4. The danger warning system as recited in claim 1, wherein means are provided for performing a reference measurement of the energy store.

* * * * *